US008036340B2

(12) United States Patent
Soto Santos

(10) Patent No.: US 8,036,340 B2
(45) Date of Patent: Oct. 11, 2011

(54) X-RAY APPARATUS

(75) Inventor: Jose-Emilio Soto Santos, Paris (FR)

(73) Assignee: General Electric Company, Schenectady, NY (US)

( * ) Notice: Subject to any disclaimer, the term of this patent is extended or adjusted under 35 U.S.C. 154(b) by 215 days.

(21) Appl. No.: 12/171,314

(22) Filed: Jul. 11, 2008

(65) Prior Publication Data

US 2009/0034686 A1 Feb. 5, 2009

(30) Foreign Application Priority Data

Jul. 19, 2007 (FR) ..... 07 56591

(51) Int. Cl.
*H05G 1/34* (2006.01)

(52) U.S. Cl. ..... 378/109; 378/101; 378/102; 378/103; 378/106; 378/110; 378/111; 378/112

(58) Field of Classification Search ..... 378/106, 378/101–103, 109–112
See application file for complete search history.

(56) References Cited

U.S. PATENT DOCUMENTS

| | | | | |
|---|---|---|---|---|
| 4,477,761 | A | 10/1984 | Wolf | |
| 5,283,512 | A | 2/1994 | Stadnick et al. | |
| 6,075,331 | A | 6/2000 | Ando et al. | |
| 6,282,260 | B1 * | 8/2001 | Grodzins | 378/87 |
| 6,727,670 | B1 | 4/2004 | Grabowski et al. | |
| 2003/0107352 | A1 * | 6/2003 | Downer et al. | 322/40 |

FOREIGN PATENT DOCUMENTS

| | | |
|---|---|---|
| DE | 10 2005 052 115 A1 | 5/2007 |
| EP | 0 946 082 A1 | 9/1999 |
| JP | 61-267300 | 11/1986 |

* cited by examiner

*Primary Examiner* — Hoon Song
*Assistant Examiner* — Mona M Sanei
(74) *Attorney, Agent, or Firm* — Global Patent Operation; Jonathan E. Thomas

(57) ABSTRACT

An X-ray apparatus includes a converter into which there is integrated a control logic circuit configured to regulate the supply voltage of a high-voltage power supply source of the X-ray apparatus. To this end, the intelligent voltage-voltage, converter is placed between the power battery and the capacitor bank. This intelligent converter is capable of determining the optimum voltage to be delivered to the generator for the radiology examination to be undertaken in regulating the current of the power battery at the necessary level of current.

9 Claims, 3 Drawing Sheets

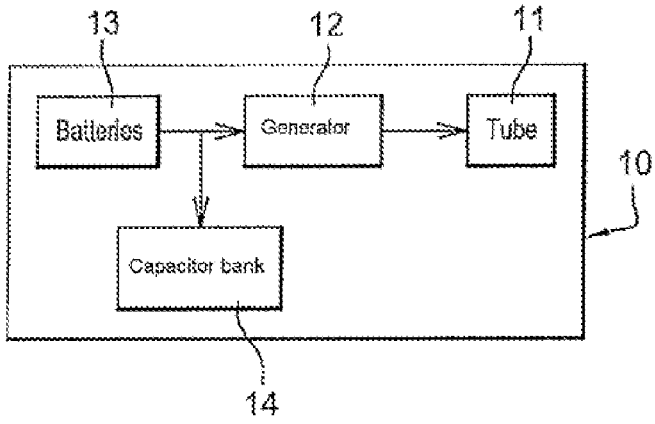
Fig. 1
Prior Art
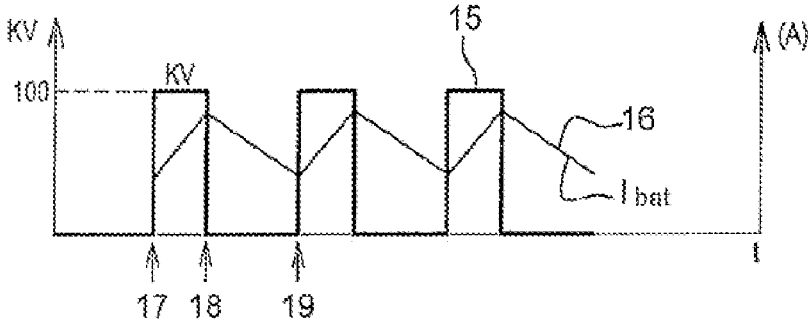
Fig. 2
Prior Art
Fig. 3
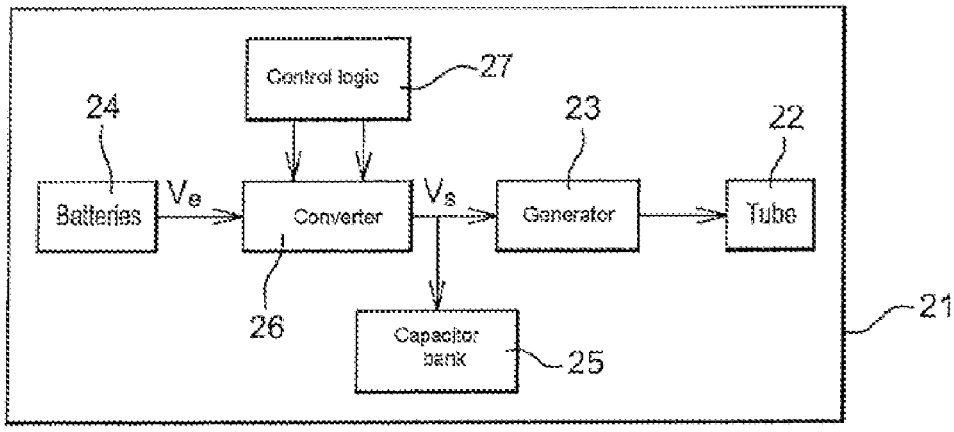
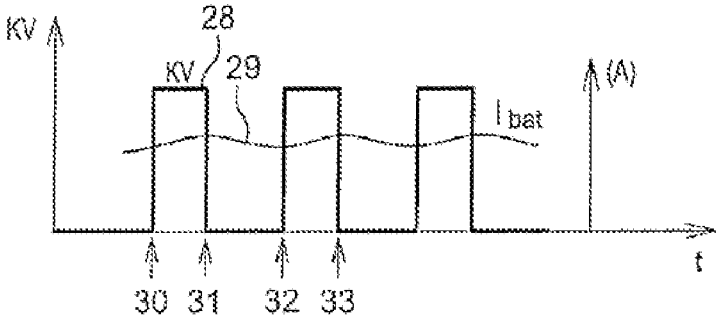
Fig. 4

X-RAY APPARATUS

CROSS-REFERENCE TO RELATED APPLICATIONS

This application claims, under 35 U.S.C. 119 (a)-(d), the benefit of the filing date of prior-filed French patent application serial number 0756591, filed Jul. 19, 2007, which is hereby incorporated by reference in its entirety.

BACKGROUND

1. Field of the Invention

Embodiments of the invention can be applied to special advantage but not exclusively in the field of medical imaging and medical diagnostic apparatuses. These diagnostic apparatuses are X-ray image acquisition apparatuses.

2. Description of the Prior Art

Today, X-ray apparatuses are used to obtain images, or even sequences of images, of an organ located in a living being, especially a human being. The X-ray apparatus has an X-ray tube generally contained in a metal sheath or casing. This metal sheath provides firstly electrical, thermal and mechanical protection for the X-ray tube. Secondly, it protects operators from electrical shocks and X-rays.

The X-ray apparatus has a high-voltage generator supplying the X-ray tube with energy. The generator is powered in certain cases by a power supply battery or power battery. When the high-voltage generator supplies the tube with a pulse of about 100 kilovolts, a sudden current draw on the power battery is generally observed. The power battery almost instantaneously reaches its peak value. This value then decreases in a substantially exponential way to swiftly reach its constant operating value. When the pulse given by the generator is terminated, the power battery suddenly stops powering the generator.

It is therefore important to reduce the peak value and the root-mean-square value of the current delivered by the power battery, in order to reduce the shocks received by the power battery. The current delivered by the power battery is very high, even for short high-voltage pulses given by the generator. This current also remains very high even when the mean power is reduced, i.e. with a duty cycle or duty cycle of ⅓. This duty cycle is the ratio between the duration of the pulse and the interval between the pulses. This duty cycle is used to compute the real time during which the pulse itself lasts.

The peak value and the root-mean-square value of the current of the power battery provide information on the life of the said battery. These power battery current values therefore lead to determining the power battery to be chosen to power the generator.

A classic solution exists to resolve the drawbacks caused by the very high rates of current of the power battery. In this classic solution, a bank of capacitors is parallel-connected to the supply battery. An example of this kind of solution is shown in FIG. 1.

FIG. 1 provides a schematic view of a topology of an X-ray apparatus 10 comprising means capable of reducing the current of the power battery. The X-ray apparatus 10 of FIG. 1 comprises a tube 11 powered by generator 12. This generator 12 delivers high-voltage pulses, for example 20-kilowatt pulses, to the tube 11. The generator 12 is powered by a power battery 13. To prevent current peaks in the power battery, a capacitor bank 14 is parallel-connected to the power battery. When energy is drawn from the generator 12, the capacitor bank 14 behaves like a discharge system and shorts the power battery 13.

The result obtained with this type of topology is shown in a graph of FIG. 2. In FIG. 2 two distinct curves are used to show the progress in time of the high voltage powering the tube and the power supply current powering the generator during a radiology examination.

The x-axis in FIG. 2 represents the time in milliseconds. The y-axis to the left represents the high voltage in kilovolts. The y-axis to the right represents the current in amperes given by the power battery. The curve 15 represents the progress in time of the high voltage powering the tube, during a radiology examination. The curve 16 represents the progress in time of the current delivered by the power battery during a radiology examination.

At the step 17, the high-voltage generator gives the tube a pulse of about a hundred kilovolts as shown by the curve 15. To this end, the power battery gives the generator a high-power current, as shown in the curve 16($I_{bat}$).

This pulse given has a width of 10 milliseconds in the example of FIG. 2, and lasts up to the step 18. Between the steps 17 and 18, the tube converts the energy given by the generator into X-ray intensity.

The step 18 marks the end of the pulse given by the generator. From the step 18 to the step 19, the current of the power battery is gradually reduced as compared with the prior art where the current was stopped suddenly. As can be seen in the curve 16, the current delivered by the power battery is filtered by the capacitor bank. This prevents current peaks so that the battery has to withstand fewer shocks.

However, this type of classic solution is not optimal, for this type of circuit is solely passive.

SUMMARY OF THE INVENTION

Embodiments of the invention address the problems of the prior art referred to above. To this end, an embodiment of the invention includes an X-ray apparatus in which a voltage-voltage converter is placed between the power battery and the capacitor bank. This intelligent converter is capable of determining the optimum voltage to be delivered to the generator as compared with the radiology examination to be undertaken while at the same time regulating the current of the power supply battery at the necessary value of current.

The converter has an intelligent embedded system comprising an algorithm for the regulation of the current of the power battery and the output voltage. This algorithm is capable of reducing the current of the power battery simply by limiting the mean value of the current. To effect this limitation, an embodiment of a method of the invention takes account of any possible inexactitude in the parameters.

The value of the capacitor and of the capacitor bank should be high enough to ensure efficient operation of the generator during the pulses. To this end, the method reduces the value of the capacitance of the capacitor bank during the pulse period of the generator and increases this during the non-pulse period of the generator. Thus, the capacitance of the capacitor bank is computed to ensure a minimum voltage for the generator. The capacitor bank thus serves as an energy buffer.

The fact of regulating the peak and root-mean-square values of the power battery reduces the energy of the heat present in the power battery, thus increasing the lifetime of a power battery of this kind. This enables the selection of small-sized types of power battery to power the generator.

In one embodiment, the intelligent converter can be mounted in the factory, directly on the tube already in use or else integrated with the X-ray generator within the transformer unit comprising the rectifier circuit and the filtering circuit. The mounting necessitates neither setting nor modification of the electrical circuits already present in the X-ray apparatus. Only a few wires are to be added to the existing circuit. The intelligent converter of the invention does not impair the original electrical circuit. If the present intelligent circuit were to suffer a malfunction in certain cases, that would not cause deterioration in the use of the X-ray apparatus would, in this case be short-circuited. Only the drawbacks of the prior art would no longer be resolved.

In one embodiment, an X-ray apparatus includes:

an X-ray tube, a generator configured to provide a high voltage to the tube, a power battery configured to supply the generator with voltage, a capacitor bank parallel-connected with the power battery;

a voltage-voltage converter connected between the power battery and the capacitor bank;

a control logic circuit capable of controlling the converter, wherein the control logic circuit comprises a duty cycle regulator capable of making a pre-defined duty cycle vary in order to regulate and optimize the current of the power battery and the output voltage of the converter.

In one embodiment, a method of operating the X-ray apparatus includes:

predetermining a duty cycle as a function of a radiology examination to be undertaken, the duty cycle being a ratio between a duration of a pulse of a generator of the X-ray apparatus and an interval between the pulses;

determining a set-point limit value of the current of the power battery of the X-ray apparatus;

measuring a current of a power battery of the X-ray apparatus;

measuring an output voltage of a converter of the X-ray apparatus;

comparing the measured current and the determined set-point limit value of the current; and regulating the duty cycle as a function of the measured output voltage and the result of the comparison;

wherein the current of the battery is regulated as a function of the regulated duty cycle, and wherein the output voltage is automatically controlled as a function of the regulated current.

BRIEF DESCRIPTION OF THE DRAWINGS

Embodiments of the invention will be understood more clearly from the following description and from the accompanying figures. These figures are given by way of an indication and in no way restrict the scope of the invention.

FIG. 1, already described, is a schematic view of a prior art topology of an X-ray apparatus comprising a means capable of reducing the current of the power battery.

FIG. 2 already described comprises two graphs showing the progress in time of the high voltage provided to the generator and of the current of the power battery, during a radiology examination, with the apparatus of FIG. 1.

FIG. 3 is a schematic view of a topology of an X-ray apparatus comprising the improved means of an embodiment of the invention.

FIG. 4 comprises two graphs showing the progress in time of the high voltage provided to the generator and of the current of the power battery, during a radiology examination, with the apparatus of FIG. 3.

DETAILED DESCRIPTION OF EMBODIMENT OF THE INVENTION

Figure 5:
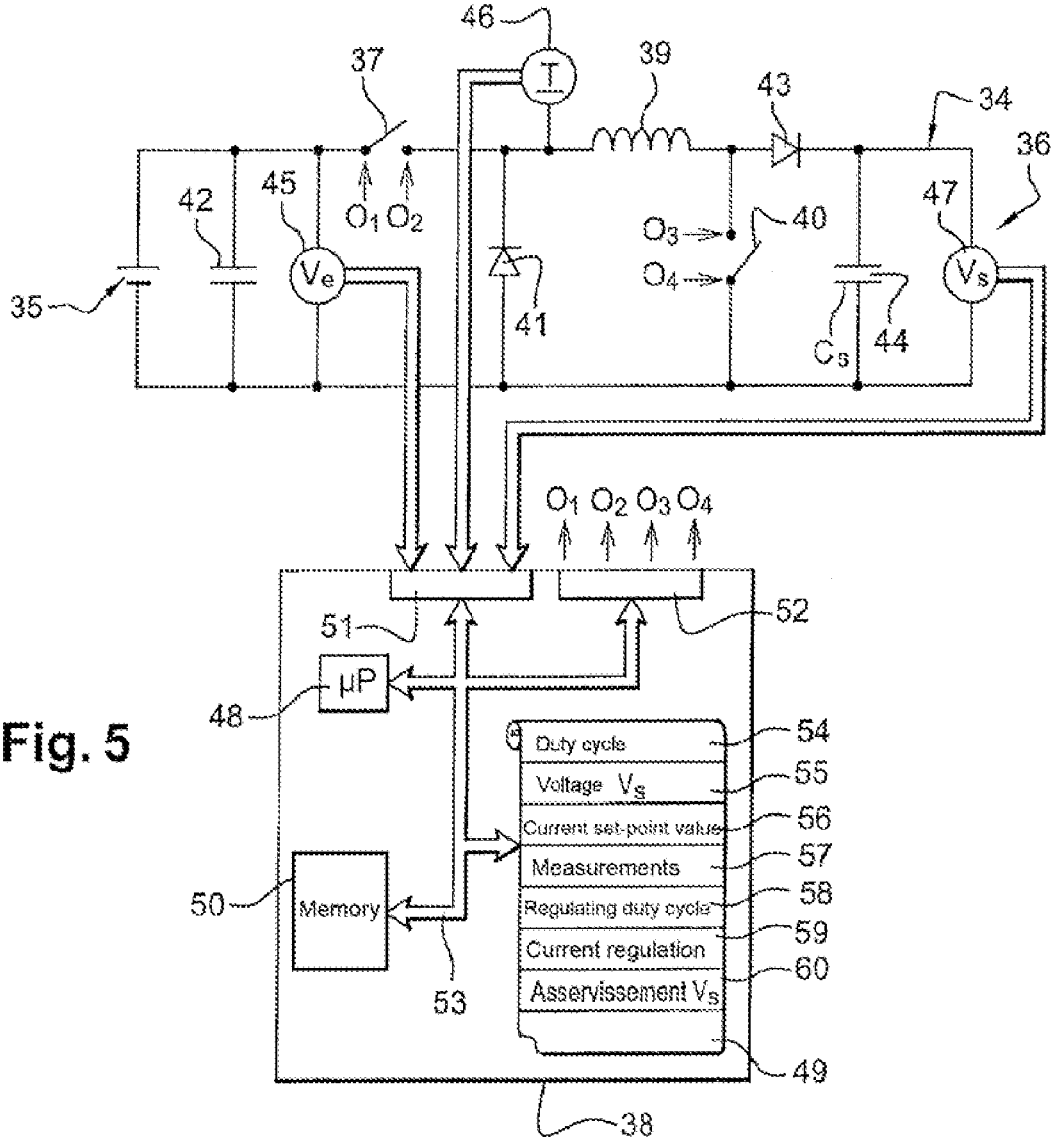
FIG. 5 is a view of a voltage-voltage converter comprising the improved means of an embodiment of the invention.

In a preferred embodiment, the intelligent voltage-voltage converter of the invention is installed in an X-ray apparatus. However, it can be installed in any other apparatus requiring an optimizing of the power battery current and, at the same time, a regulation of the output voltage.

FIG. 3 provides a schematic view, in one example, of an X-ray apparatus comprising an intelligent voltage-voltage converter of an embodiment of the invention. The X-ray apparatus 21 comprises an X-ray tube 22, a high-voltage generator 23 and the computer (not shown). These elements may be physically isolated, as in most fixed radiography installations. They may be assembled together in a compact unit that is designed to be moved to patients' bedsides.

The tube 22 comprises a cathode electrode responsible for sending out electrons and an anode electrode which is a source of the production of X-rays. The tube 22 is surrounded with a protective casing such as a sheath to ensure electrical, thermal and mechanical protection while at the same time protecting operators against leakage radiation.

The generator 23 produces a voltage adjustable between 40 kV and 150 kilovolts. The generator 23 is powered in one example by a power battery 24. In order to prevent current peaks in the power battery, the apparatus 21 comprises a capacitor bank 25 parallel-connected to the power battery 24. In order to regulate, limit and optimize the current of the power battery and the voltage delivered to the generator 23, the apparatus comprises a voltage-voltage converter 26. This converter 26 is controlled by a control logic circuit 27. The voltage-voltage converter 26 may be a boost converter. It is clearly understood that the converter may also be a buck converter or a buck-boost converter.

The working of the converter 26 and of the control logic circuit 27 shall be described in greater detail with reference to FIG. 5.

The result obtained with the X-ray apparatus of an embodiment of the invention is shown in FIG. 4 in a graph. FIG. 4 gives a view, in two distinct curves, of the progress in time of the high voltage powering the tube and of the current of the power battery powering the generator during a radiology examination.

The x-axis in FIG. 4 represents the time in milliseconds. The y-axis to the left represents the high voltage in kilovolts. The y-axis to the right represents the current in amperes given by the power battery. The curve 28 represents the progress in time of the high voltage powering the tube, during a radiology examination. The curve 29 ($I_{bat}$) represents the progress in time of the current delivered by the power battery during a radiology examination.

At the step 30, the high-voltage generator gives the tube a pulse of about a hundred kilovolts as shown by the curve 28. To this end, the power battery gives the generator a high-power current, as shown in the curve 29.

This given pulse has a width of 10 milliseconds in the example of FIG. 4, and lasts up to the step 31. Between the steps 30 and 31, the tube converts the energy given by the generator into X-ray intensity.

The step 31 marks the end of the pulse given by the generator. From the step 31 to the step 32, the current of the power battery is practically constant as compared with the prior art where the current was stopped suddenly or reduced gradually.

As can be seen in the curve 29, the current delivered by the power battery is filtered by the capacitor bank and regulated by the intelligent converter.

FIG. 5 shows a voltage-voltage converter 34 comprising an intelligent system of an embodiment of the invention. In the example of FIG. 5, the voltage-voltage converter considered has a buck-boost converter topology. It is clearly understood that the voltage-voltage converter of an embodiment of the invention may have other topologies such as for example a boost converter or a buck converter topology.

The converter 34 has a main switch 37. This main switch 37 can be a high-frequency transistor. The main switch 37 can also be a low-frequency transistor. In the example of FIG. 2, the main switch 37 is a high-frequency transistor. This type of main switch 37 enables the output voltage to be regulated and also enables the power factor to be corrected. The main switch 37 is periodically switched over on the commands of a control logic circuit 38. The control logic circuit 38 sends the commands O1 or O2 to the converter 34 to respectively control the closing and opening of the main switch 37. The converter 34 may include a diode integrated into the main switch 37.

The converter 34 comprises an inductor 39 and a secondary switch 40 that are parallel to the main switch 37 and series-mounted. This secondary switch 40 and this inductor 39 are directly connected to each other. The opening and closing of the secondary switch 40 are controlled by the control logic circuit 38. The control logic circuit 38 sends the commands O3 or O4 to respectively command the opening or closing of the secondary switch 40.

The converter 34 has a first diode 41 and a first capacitor 42. The first diode 41 and the first capacitor 42 are parallel-connected with the main switch 37. The first diode 41 enables the voltage to be not inverted at the terminals of the main switch 37.

The converter 34 also has a second diode 43 and a second capacitor 44. This second diode 43 and this second capacitor 44 parallel-connected with the secondary switch 40. The second diode 43 and the second capacitor 44 are designed to protect the secondary switch 40 when it is being opened or closed.

In the structure of the converter 34, the components may be replaced by the corresponding components. Similarly, other components may be interposed with the described components of the converter 34.

In an embodiment of the invention, three sensors are installed in the converter 34. A first voltage sensor 45 is parallel-connected with the input 35 in order to measure the input voltage Ve. A second current sensor 46 is a series-connected with the input 35 in order to measure the current of the power battery. A third sensor 47 is connected to the output 36 in order to measure the output voltage of the converter 34.

The measurements made by these three sensors 45, 46 and 47 are transmitted to the control logic circuit 38. The control logic circuit 38 is often made in integrated-circuit form. In one example, this control logic circuit comprises a microprocessor 48, a program memory 49, a data memory 50, an input interface 51 and an output interface 52. The microprocessor 48, the program memory 49, the data memory 50, the input interface 51 and the output interface 52 are interconnected by a two-way bus 53.

In practice, when an action is attributed to a device, this action is performed by a microprocessor of the device commanded by instruction codes recorded in a program memory of the device. The control logic circuit 38 is such a device.

The program memory 49 is divided into several zones, each zone corresponding to instruction codes to fulfill a function of the device. Depending on the various embodiments of the invention, the memory 49 comprises a zone 54 comprising instruction codes to predetermine the duty cycle. The duty cycle is the ratio between the duration of the pulse provided by the generator and the interval between the buses.

The memory 49 has a zone 55 comprising instruction codes to determine the output voltage Vs to be applied to the generator as a function of the radiology examination to be undertaken and as a function of the duty cycle. The memory 49 has a zone 56 comprising instruction codes to compute a set-point value of limitation of the current of the power battery. The memory 49 has a zone 57 comprising instruction codes to command the measurements of the three sensors of voltage and current measurements.

The memory 49 has a zone 58 comprising instruction codes to regulate the duty cycle as a function of the result of comparison between the current measured and the set-point current limit value. The memory 49 has a zone 59 comprising instruction codes to regulate the current delivered by the battery as a function of the regulated duty cycle. The memory 49 has a zone 60 comprising instruction codes to set up an automatic feedback control of the output voltage Vs as a function of the regulated current.

Figure 6:
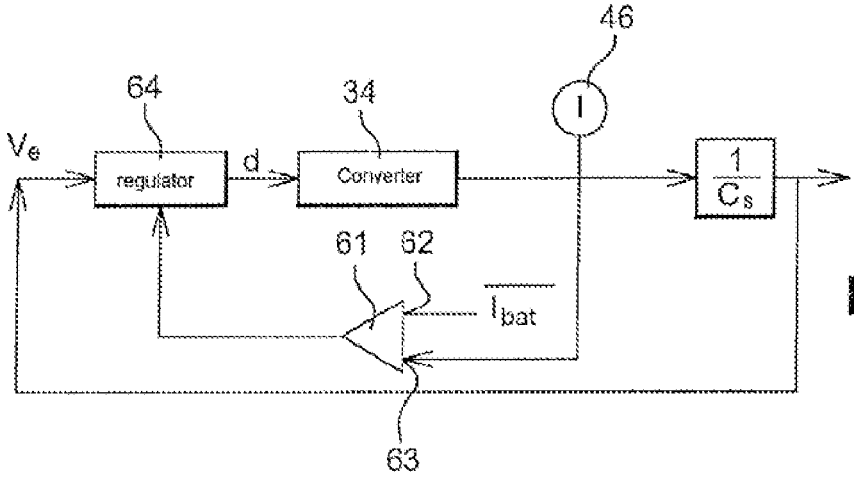
FIG. 6 is a schematic view of an example of the regulation of the current of the power battery according to an embodiment of the invention.

FIG. 6 provides a schematic view of an example of regulation of the current of the power battery. The control logic circuit computes a set-point limit value of the current of the power supply battery. In a preferred embodiment, this set-point limit value of the current is equal to the mean current of the power battery. The mean current of the power battery is determined when the generator is in pulse mode. The mean current of the power battery is computed according to the following equation:

$$\overline{I_{battery}} = \frac{KV \cdot \text{mA} \cdot \text{dutycycle}}{Ve \cdot \eta_{generator}}$$

where KV is the high voltage delivered by the generator to the X-ray tube, mA is the measured current of the power battery, Ve is the measured input voltage of the converter and is the efficiency of the generator. The non-measured parameters are determined as a function of the radiology examination to be undertaken.

The control logic circuit transmits each measurement performed by the current sensor 46 to a comparator 61. This comparator 61 has two inputs 62 ($\overline{I_{bat}}$) and 63. At input 62, it receives the set-point current limit value computed and at the input 63 it receives the power battery current measured by the sensor 46. The comparator 61 transmits the result of the comparison to regulator 64 of the control logic circuit.

The regulator 64 inputs the result of the comparison of the comparator 61 and the measurement of the output voltage Vs. The regulator outputs a new duty cycle (d) capable of limiting the current, prompting an automatic feedback control of the voltage. The greater the duty cycle (d), the higher is the current of the power battery. The current of the power battery respectively increases or decreases proportionally to the increase or decrease of the duty cycle (d). The regulator 64 plays on the duty cycle (d) in order to keep the output voltage Vs constant.

The use of a voltage-voltage converter between the power battery and the X-ray generator reduces or limits the current delivered by said power battery. This reduction or limiting of the power battery current can be further optimized by the use of a capacitor bank connected to the output of the voltage-voltage converter.

When the X-ray apparatus takes only one radiology shot (or "rad shot"), the voltage-voltage converter charges the capacitor bank, trying to keep it at the target voltage Vs during the pulse of the generator. The charging of the capacitor bank during the exposure of the patient to X-rays lengthens the exposure time of the patient to X-rays. The powering of the tube lasts after the pulse of the generator until the energy stored in the capacitors is exhausted or until the voltage is no longer sufficient to perform the requested exposure. A method of an embodiment of the invention limits the current of the power battery to acceptable values from said power battery. The power battery with the current limitation of an embodiment of the invention cannot deliver a peak current.

When the X-ray apparatus takes a succession of radiology shots (namely a cinema shot), an embodiment of a method of the invention adapts the limit of the consumption current of the power battery at the output of the generator. With knowledge of the protocol applied to the patient, the voltage-voltage converter optimizes the current of the power battery in using the energy stored in the capacitor bank. This energy is stored for periods with an instantaneous power value greater than a mean power value.

Figure 7:
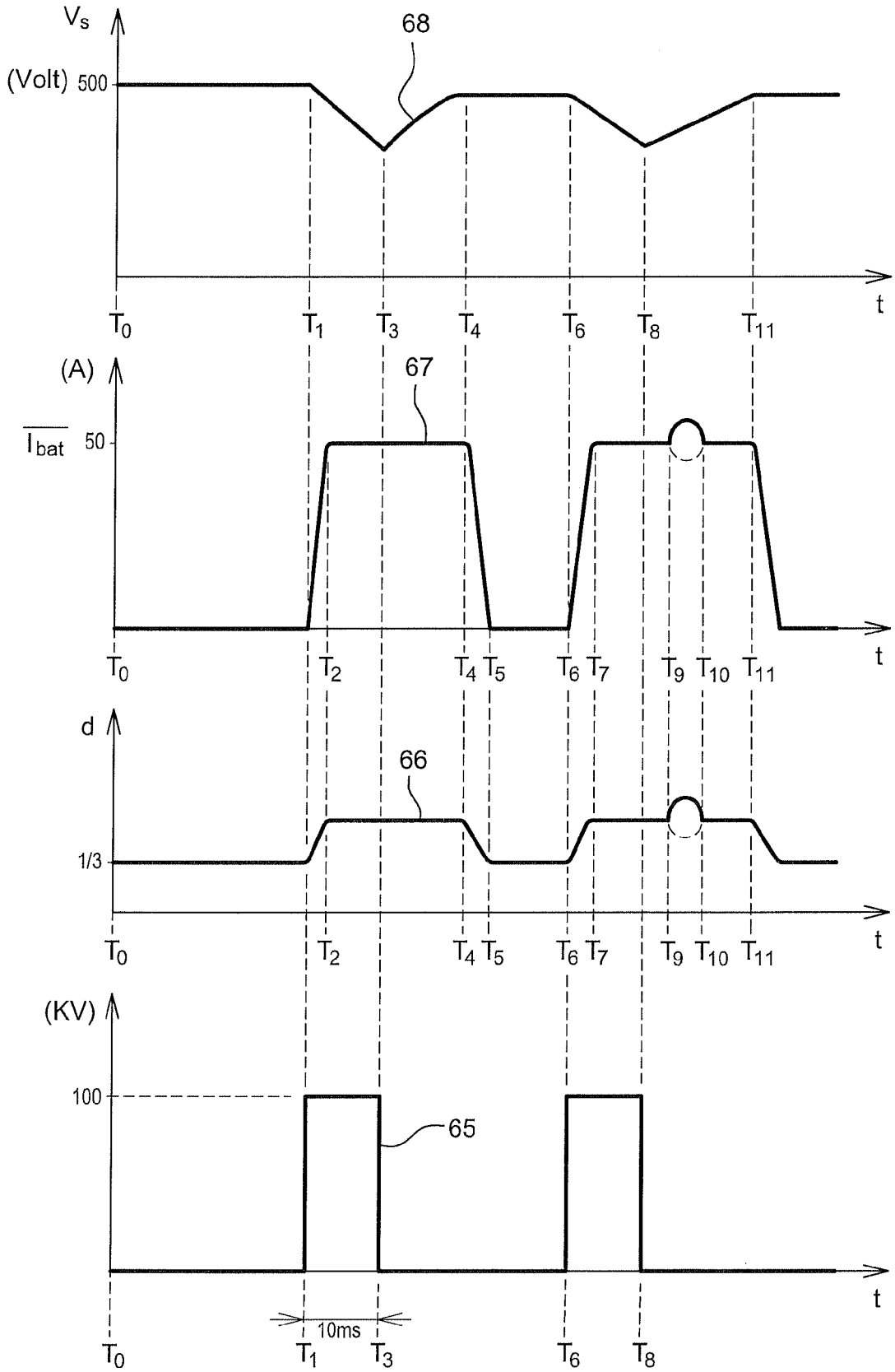
FIG. 7 illustrates the steps of operation of the X-ray apparatus according to an embodiment of the invention.

FIG. 7 is a graph showing the progress in time of the high voltage powering the tube, the voltage powering the generator, the duty cycle (d)the mean current ($\overline{I_{bat}}$) of the power battery, during a radiology examination, with an X-ray apparatus using the intelligent converter of an embodiment of the invention.

The progress in time of the high voltage powering the tube is represented by a curve 65 in the graph of FIG. 7. The curve 65 is represented in a Cartesian referential system where the x-axis corresponds to the time in milliseconds and the y-axis to the high voltage in kilovolts.

The progress in time of the duty cycle is represented by a curve 66 in the graph of FIG. 7. The curve 66 is represented in a Cartesian referential system where the x-axis corresponds to the time in milliseconds and the y-axis to the duty cycle.

The progress in time of the mean current of the power battery is represented by a curve 67 in the graph of FIG. 7. The curve 67 is represented in a Cartesian referential system where the x-axis corresponds to the time in milliseconds and the y-axis to the mean current of the power battery in amperes.

The progress in time of the voltage powering the generator is represented by a curve 68 in the graph of FIG. 7. The curve 68 is represented in a Cartesian referential system where the x-axis corresponds to the time in milliseconds and the y-axis to the voltage.

At the step T0, the output voltage Vs given to the generator is optimal. It is equal in one example, the example of FIG. 7, to about 500 V. The mean current of the power battery is equal to zero and the duty cycle is predefined. It may be equal in one example to ⅓. At the step T0, the generator is in operational mode.

At the step T1, the generator gives a pulse equal for example to 100 kilovolts to the X-ray tube. The output voltage Vs diminishes. The control logic circuit increases the current of the power battery in order to reset the output voltage Vs at the optimal level. To this end, the power battery gives the generator a current which reaches a set-point value of limitation of the current of the power battery with a very short build-up time. The set-point value of limitation of the current is determined not as a function of components as in the prior art but as a function of the mean value of the current of the power battery computed by the control logic circuit.

At the step T2, the control logic circuit determines a new duty cycle in order to regulate the current so that it does not exceed the set-point value of limitation. The measurements of the current of the power battery and of the output voltage enable the control logic circuit to determine a new duty cycle. In the example of FIG. 7, the set-value of limitation is equal to about 50 amperes.

The control logic circuit increases the duty cycle as a function of the current. But once the current of the power battery reaches the set-point limit value, the control logic circuit limits the duty cycle to regulate the current.

The step T3 marks the end of the pulse which lasts 10 milliseconds. The output voltage Vs increases. The current of the power battery is limited by the duty cycle.

At the step T4, the output voltage Vs reaches its optimum value. The current of the power battery diminishes to reach a null value at the step T5. Similarly, the duty cycle diminishes to reach its initial value at the step T5.

The step T6 marks the start of a new pulse given by the generator to the X-ray tube. The output voltage Vs diminishes. The power battery gives the generator a current which, with a very short build-up time, reaches the set-point limit value of the current of the power battery.

At the step T7, the control logic circuit determines a new duty cycle in order to regulate the current so that it does not exceed the set-point limit value. The step T8 marks the end of the pulse which lasts 10 milliseconds. The output voltage Vs increases. The current of the power battery is limited by the duty cycle.

When, for any reason whatsoever, the current of the power battery increases, as shown between the step T9 and the step T10, the control logic circuit determines a new duty cycle capable of resetting the current of the power battery at a value equal to the set-point limit value. The control logic circuit in this case increases the value of the duty cycle.

When, for any reason whatsoever, the current of the power battery diminishes, as shown between the step T9 and the step T10, the control logic circuit determines a new duty cycle capable of resetting the current of the power battery at a value equal to the set-point limit value. The control logic circuit in this case diminishes the value of the duty cycle.

At the step T11, the output voltage Vs reaches its optimum value. The current of the power battery diminishes to reach a null value. Similarly, the duty cycle diminishes to reach its initial value.

What is claimed is:

1. An X-ray apparatus comprising:

an X-ray tube;

a generator configured to provide a high voltage to the X-ray tube;

a power battery configured to supply the generator with voltage;

a capacitor bank parallel-connected with the power battery;

a voltage-voltage converter connected between the power battery and the capacitor bank;

a control logic circuit capable of controlling the converter;

a first voltage sensor parallel-connected with an input of the converter and configured to measure an input voltage Ve;

a second current sensor series-connected with the input of the converter and configured to measure a current of the power battery; and a third sensor connected to an output of the converter and configured to measure the output voltage of the converter, wherein the measurements made by these three sensors are transmitted to the control logic circuit, and wherein the control logic circuit comprises a duty cycle regulator capable of making a predefined duty cycle vary in order to regulate and optimize a current of the power battery and an output voltage of the converter.

2. The X-ray apparatus of claim 1, wherein the control logic circuit has a current comparator, wherein the current comparator has two inputs, a first input receiving a set-point current limit value of the power battery and a second input receiving the measurement of the current of the power battery made by the second current sensor series-connected with the input of the converter, and wherein the comparator has an output connected to an input of the duty cycle regulator.

3. The X-ray apparatus of claim 1, wherein the regulator has another input capable of receiving the measurement from the third sensor for measuring the output voltage of the converter, and wherein the regulator has an output connected to the converter capable of giving the converter an adjusted duty cycle.

4. The X-ray apparatus of claim 2, wherein the set-point current limit value is a mean value of the current of the power battery.

5. The X-ray apparatus of claim 1, wherein the voltage-voltage converter is a boost converter, a buck converter, or a buck-boost converter.

6. The X-ray apparatus of claim 1, wherein the control logic circuit is integrated with the converter.

7. The X-ray apparatus of claim 1, wherein a mean value of the current of the power battery is determined according to the following equation:

$$\overline{I_{battery}} = \frac{KV \cdot \mathrm{mA} \cdot \mathrm{dutycycle}}{Ve \cdot \eta_{generator}}$$

where KV is the high voltage delivered by the generator to the X-ray tube, mA is the measured current of the power battery, Ve is the measured input voltage of the converter and $\eta_{generator}$ is the efficiency of the generator.

8. A method of operating an X-ray apparatus, the method comprising:

predetermining a duty cycle as a function of a radiology examination to be undertaken, the duty cycle being a ratio between a duration of a pulse of a generator of the X-ray apparatus and an interval between the pulses;

determining a set-point limit value of the current of the power battery of the X-ray apparatus;

measuring a current of a power battery of the X-ray apparatus;

measuring an output voltage of a converter of the X-ray apparatus;

comparing the measured current and the determined set-point limit value of the current; and regulating the duty cycle as a function of the measured output voltage and the result of the comparison, wherein the current of the battery is regulated as a function of the regulated duty cycle, and wherein the output voltage is automatically controlled as a function of the regulated current.

9. The method of claim 8, wherein the determined set-point current limit value is a mean value of the current of the power battery determined according to the following equation:

$$\overline{I_{battery}} = \frac{KV \cdot \mathrm{mA} \cdot \mathrm{dutycycle}}{Ve \cdot \eta_{generator}}$$

where KV is the high voltage delivered by the generator to the X-ray tube, mA is the measured current of the power battery, Ve is the measured input voltage of the converter and $\eta_{generator}$ is the efficiency of the generator.

* * * * *